US008354959B2

(12) United States Patent
Ahlberg

(10) Patent No.: US 8,354,959 B2
(45) Date of Patent: Jan. 15, 2013

(54) CONTROL SYSTEM FOR CONTROLLING THE ELECTRICAL TILT OF AN ANTENNA

(75) Inventor: Mikael Ahlberg, Taby (SE)

(73) Assignee: Powerwave Technologies Sweden AB, Taby (SE)

( * ) Notice: Subject to any disclaimer, the term of this patent is extended or adjusted under 35 U.S.C. 154(b) by 370 days.

(21) Appl. No.: 12/302,788

(22) PCT Filed: May 25, 2007

(86) PCT No.: PCT/SE2007/000507

§ 371 (c)(1), (2), (4) Date: Aug. 2, 2010

(87) PCT Pub. No.: WO2007/139467

PCT Pub. Date: Dec. 6, 2007

(65) Prior Publication Data

US 2010/0289698 A1 Nov. 18, 2010

(30) Foreign Application Priority Data

May 31, 2006 (SE) ..... 0601201

(51) Int. Cl.
*H01Q 3/00* (2006.01)

(52) U.S. Cl. ..... 342/372

(58) Field of Classification Search ..... 342/81, 342/359, 369, 372, 374; 343/768, 777, 853
See application file for complete search history.

(56) References Cited

U.S. PATENT DOCUMENTS

| | | | | |
|---|---|---|---|---|
| 6,198,458 | B1 | 3/2001 | Heinz et al. | 343/853 |
| 7,031,751 | B2 | 4/2006 | Hurler et al. | 455/557 |
| 7,177,667 | B2 | 2/2007 | Kim | |
| 2003/0109231 | A1 | 6/2003 | Marcus et al. | |

FOREIGN PATENT DOCUMENTS

| | | |
|---|---|---|
| WO | 96/14670 | 5/1996 |
| WO | WO96/37922 A1 | 11/1996 |
| WO | 02/05383 | 1/2002 |

(Continued)

OTHER PUBLICATIONS

PCT International Search Report for International Application No. PCT/SE2007/000507 dated Jun. 20, 2007.

(Continued)

*Primary Examiner* — Dao Phan
(74) *Attorney, Agent, or Firm* — OC Patent Law Group

(57) ABSTRACT

An improved control system for controlling the electrical tilt, i.e. the electrically controlled inclination of a radiated beam, of a base station antenna (70) with a vertical row of antenna elements is disclosed. The antenna includes a phase shifting device (73) including a tilt adjusting mechanism with a displaceable mechanical element for adjusting an electrical tilt setting of the antenna lobe being radiated from the antenna. The control system is divided into two parts, namely a first part, including the entire tilt adjusting mechanism (73), an electrical motor (75) and a position sensor (74), these elements constituting internal components being arranged inside the antenna casing (70), and a second part, including the remaining components of the control system, including an electrical motor control circuit (51; 61), and a logic circuit (56; 66) determining the electrical tilt setting. The external components are disposed in a separate, external control unit (50; 60) located outside but in the vicinity of the antenna casing (70), and are adapted for operative coupling, by way of a direct electric wire connection or a capacitive coupling, to the internal components (73,74,75) located inside the antenna casing.

14 Claims, 4 Drawing Sheets

FOREIGN PATENT DOCUMENTS

| | | |
|---|---|---|
| WO | WO02/35651 A1 | 5/2002 |
| WO | 02/061877 | 8/2002 |
| WO | 03/036756 | 5/2003 |
| WO | 2006/057612 | 6/2006 |
| WO | 2006/057613 | 6/2006 |

OTHER PUBLICATIONS

Supplemental European Search Report pertaining to European Patent Application No. EP07748171 mailed Jun. 17, 2009.

PCT Written Opinion of the International Searching Authority for Application No. PCT/SE2007/000507 mailed Jun. 20, 2007.

CONTROL SYSTEM FOR CONTROLLING THE ELECTRICAL TILT OF AN ANTENNA

FIELD OF THE INVENTION

The present invention relates to a control system for controlling the electrical tilt, i.e. the electrically controlled inclination of a radiated beam, of an antenna unit, e.g. a base station antenna mounted on a tower or on a frame structure, the antenna unit being provided with a casing accommodating a number of antenna elements, a feeder cable coupled to the antenna elements for feeding RF energy to and from the antenna elements, and a phase shifting device including a tilt adjusting mechanism with a displaceable mechanical element for adjusting an electrical tilt setting of the antenna lobe being radiated from the antenna, said control system comprising an actuating device, including an electric motor for actuating said displaceable mechanical element, and a position sensor for sensing the position of said displaceable mechanical element.

The invention also relates to an antenna system comprising an antenna unit with such a control system.

PRIOR ART AND BACKGROUND OF THE INVENTION

Such antenna systems are previously known, e.g. from the published international patent applications WO 96/37922 A1 and WO 02/35651 A1 (both in the name of Allgon AB). In these known systems, the tilt adjusting mechanism comprises a mechanical rod, which is linearly movable back and forth and which extends through an opening in the bottom end wall of the casing for manual or motor driven actuation so as to effect the desired adjustment of the electrical tilt setting.

For manual operation, the rod may be formed with a pinion engaging with a gear mechanism coupled to a control knob which can be manually turned around. In motor driven systems, see e.g PCT/SE2005/001777 (Powerwave Technologies Sweden AB), an electrical motor, such as a stepping motor, is arranged below the antenna casing and is connected with a driving gear to the rod with the pinion for moving the rod which extends through the wall of the antenna casing.

A proposal has also been made to couple a motor-driven member by a magnetic coupling with coupling members located inside and outside the antenna casing. See PCT/SE2005/001776 (Powerwave Technologies Sweden AB).

Moreover, it is also well-known to effect the desired adjustment by remote control of such an electric motor being connected to the tilt adjustment mechanism, see e.g. the patent specification U.S. Pat. No. 6,198,458 B1 (Deltec). Here, the entire control system, including the tilt adjustment mechanism, the electric motor and most of the associated electronic circuitry, is disposed inside the antenna casing.

The above-mentioned systems are relatively complicated and expensive to manufacture. However, antennas sometimes have to be replaced so as to meet new requirements and standards, and such replacement or upgrading is therefore very expensive since all parts of the system, including the antenna elements, the feed structure, the tilt adjusting mechanism and the control system, have to be replaced.

A proposal permitting replacement of the control system for a base station antenna is disclosed in the published international patent application WO 02/061877 (Kathrein).

Here, the entire control system, including the electronic circuits and an electrical motor, is mounted in a separate unit outside the antenna casing, so as to permit replacement. The displaceable mechanical element, in the form of a rotatable shaft, extends through an opening at the bottom of the antenna casing and engages with the electric motor (or a drive member coupled thereto). Of course, such separate units are also relatively expensive to replace at the antenna site. Moreover, mechanical elements disposed partially outside the antenna casing are exposed to the prevailing climatic conditions and have to be sturdy and weather resistant.

SUMMARY OF THE INVENTION

Against this background, a primary object of the present invention is to provide an improved control system for controlling the electrical tilt of an antenna unit, such that the control system is easy to manufacture and permits easy and inexpensive mounting, upgrading and replacement. A further object is to provide an antenna system with an integrated control system which is safely contained in a casing, without any movable parts extending through the casing wall, and which has a clean exterior appearance.

According to another aspect of the invention, a still further object is to provide a system where some of the components of the control system are contained in a portable, hand-held device whereby the components within the antenna casing can be reduced to a minimum, making the stationary antenna system less complicated and less expensive.

The primary object is achieved, for a control system of the kind defined in the opening paragraph, by dividing the components of the control system into two parts, namely:

- a first part, including the entire tilt adjusting mechanism, said electrical motor and said position sensor, these elements constituting internal components being arranged inside the antenna casing, and
- a second part, including the remaining components of the control system, these components constituting external components, including an electrical motor control circuit, and a logic circuit determining the electrical tilt setting, said external components being disposed in at least one separate, external control unit located outside but in the vicinity of said antenna casing, and being adapted for operative coupling to said internal components located inside said antenna casing.

Thus, the main idea of the invention is to divide the control system into two parts, one inside the antenna casing and the other in a separate, external unit located outside but in the vicinity of the antenna casing. In this way, the antenna unit within the casing can be made relatively simple, and upgraded or new embodiments, meeting new requirements or standards, can be installed in a modified external unit, without having to replace the antenna elements, the feed cables, the tilt adjustment mechanism, the electric motor or the position sensor inside the antenna casing. The coupling between the internal and the external components of the control system is achieved either by a direct electrical wire connection or by a capacitive coupling. In either case, there is no need for any mechanical connection between the antenna unit and the external part of the control system.

The separate, external control unit may either be in the form of a stationary box, which operates automatically and which is disposed adjacent to the antenna casing, in particular at the lower end wall thereof, or in the form of a portable hand-held control unit, for manual setting of the electrical tilt of the antenna. It is also possible to provide for a portable hand-held control unit in combination with a stationary box.

As in the existing control systems, there is a possibility to remotely control the electrical tilt setting of the antenna, e.g.

from a base station, via an antenna line master control network, or an IP Network from an operation and maintenance centre (OMC).

Various detailed embodiments and advantages of the control system according to invention will now be described with reference to the appended drawings illustrating some preferred embodiments.

DESCRIPTION OF PREFERRED EMBODIMENTS

Figure 1:
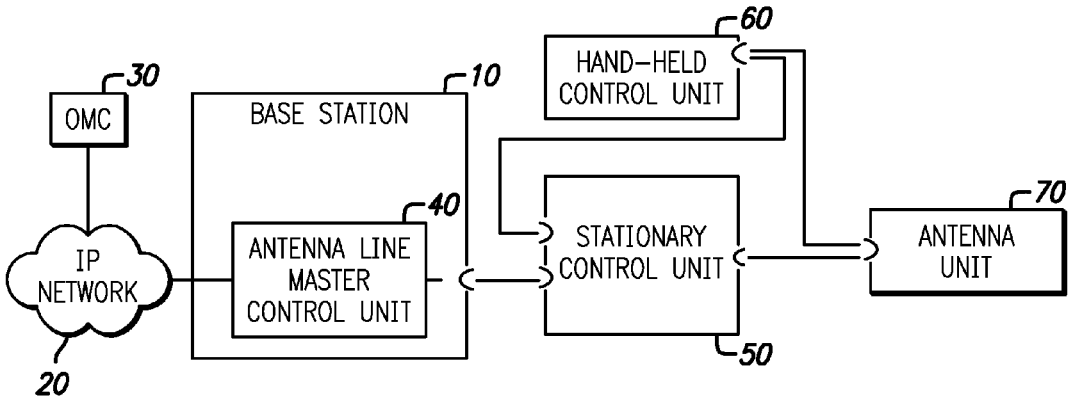
FIG. 1 illustrates schematically an overall communication system including an antenna system and a control system according to the present invention.

The communication system illustrated schematically in FIG. 1 includes a base station 10 being connected, on the one hand, to an IP network 20 including an operation and maintenance centre (OMC) 30, at a remote location and, on the other hand, via an antenna line master control unit (MCU) 40, an antenna system with a stationary control unit 50, a hand-held control unit 60 and an antenna unit 70.

The external control units 50 and 60 can be used alone or in combination with each other. Each of them contain, as appears from FIGS. 3 and 4, some external components of a control system serving to adjust the electrical tilt of the antenna unit 70. The antenna unit 70 also includes, as is schematically shown in FIG. 2, a number of components forming part of the control system.

The antenna unit 70 includes a set of antenna elements 71*a*, 71*b*, 71*c*, 71*d*, 71*e* being arranged in a vertical column (or in an array including a number of vertical columns arranged side by side). The antenna elements 71*a-e* are connected to individual feed cables 72*a*, 72*b*, 72*c*, 72*d*, 72*e*, respectively, so as to receive and transmit radio frequent energy, e.g. in the microwave range, in one or more frequency bands, possibly in two orthogonal polarisations, in which case each antenna element is connected to two feed lines. Each antenna element may be a dipole or a patch, as is well-known to those skilled in the art.

The radiated lobe, resulting from the individual radiation from the individual antenna elements 71*a-e*, may be controlled in respect of its main direction in relation to a horizontal direction, by controlling the phase of the signal to each antenna element. Thus, by shifting the phase successively along the vertical column, the lobe can be inclined upwards or downwards relative to the horizontal direction, a so called "electrical tilt" or "electrical down tilt", the latter expression being used in those normal cases where the beam lobes are normally directed a few degrees below the horizontal direction. Such phase shifting devices are frequently used nowadays, rather than mechanically tilting the whole antenna unit.

Figure 2:
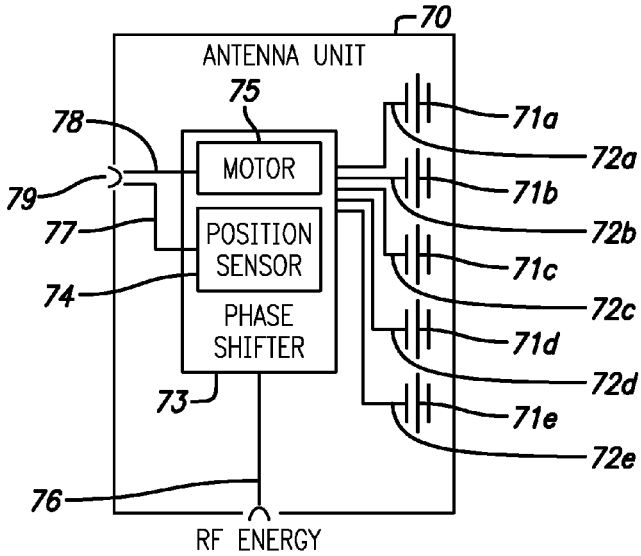
FIG. 2 shows schematically an antenna unit forming a part of the communication system of FIG. 1.

As is schematically indicated in FIG. 2, the antenna unit 70 is provided with a phase shifter 73, e.g. in the form of a mechanical rod which is linearly movable and carries a dielectric material which will influence the propagation velocity of the signal to each antenna element. When the rod is moved, the phase of the signal will be influenced, and the electrical tilt of the antenna can thereby be adjusted by moving the rod. The mechanical arrangement as such is not part of the present invention (see the documents referred to above), the essential feature being that there is some kind of a mechanical element which can be displaced for the purpose of adjusting the electrical tilt.

According to the present invention, the control system for controlling the electrical tilt of the antenna unit is structured in an improved and favourable way. Thus, some components of the control system are disposed in the antenna unit 70, within the same antenna casing, whereas the remaining components are arranged in a separate, external unit 50,60 located outside but in vicinity of the antenna casing. More particularly, the entire tilt adjusting mechanism of the phase shifter 73, an electrical motor 75 and a position sensor 74 are disposed inside the antenna casing, denoted schematically by the reference numeral 70.

The RF signals to and from the antenna elements are transferred via a feed cable 76, possibly comprising a number of feed lines, one for each polarisation, and possibly a number of such feed lines (e.g. in separate coaxial cables) in case the antenna unit operates in a number of frequency bands (possibly one feed line for each frequency band and each polarization).

The electrical motor 75 is directly and mechanically coupled to the mechanical element, such as a rod, of the phase shifter 73, and the position sensor 74 is arranged so as to sense or measure the current position of the mechanical element. Hereby, it will be possible to achieve a closed loop control of the movement of the mechanical element, by way of sensing signals and control signals, respectively, being transferred through associated electrical control wires 77 and 78.

Figure 6:
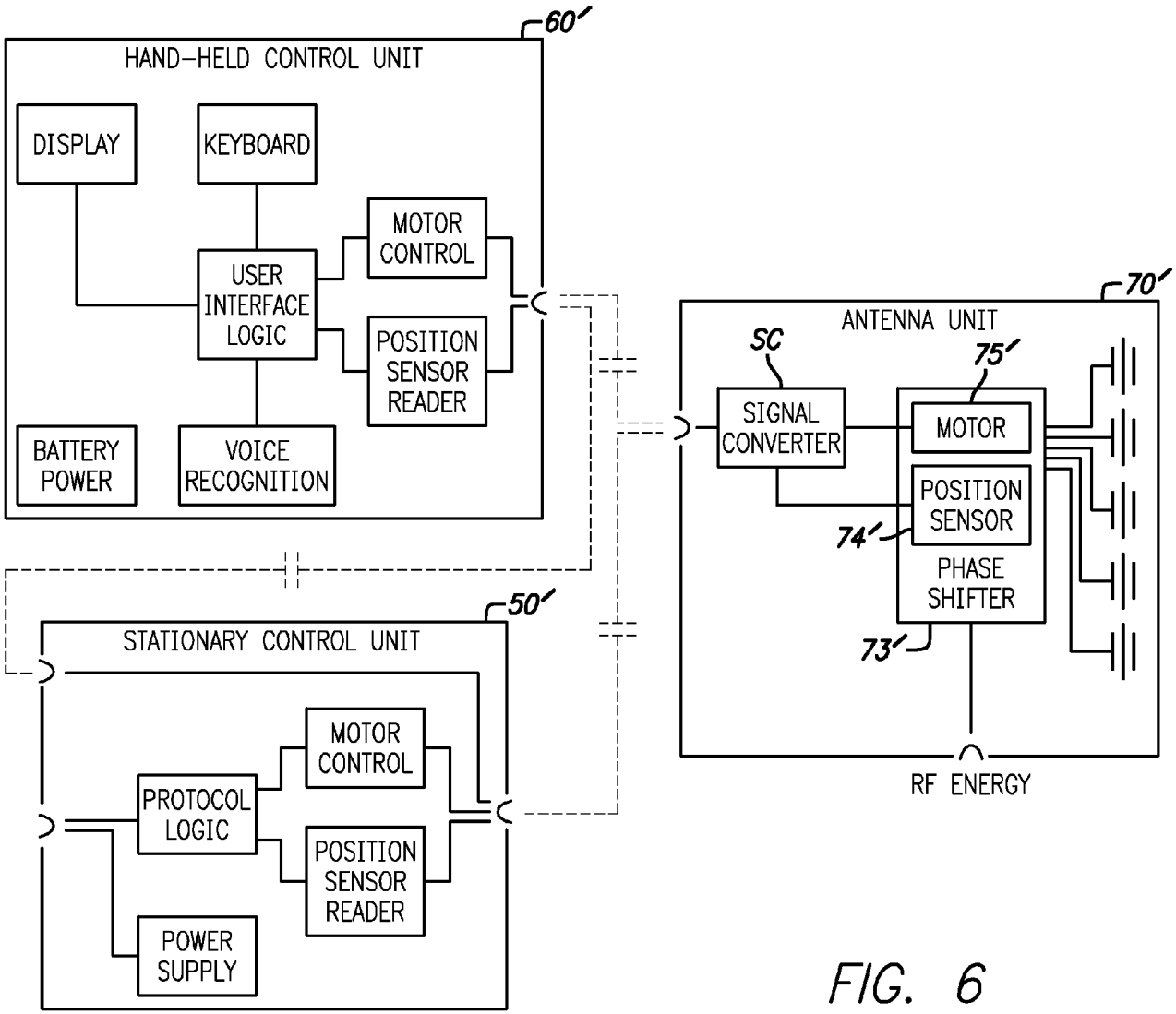
FIG. 6 shows a modified version of the control system of FIG. 5.

In this way, the only elements extending through the casing 70 of the antenna unit are electrical feed cables and control wires, via a connector 79. In fact, it is possible and most advantageous to let the control signals be superposed on the RF signals, using the same electrical cable or cables. Alternatively, the coupling of the control signals may be effected by capacitive coupling as illustrated in FIG. 6.

Figure 3:
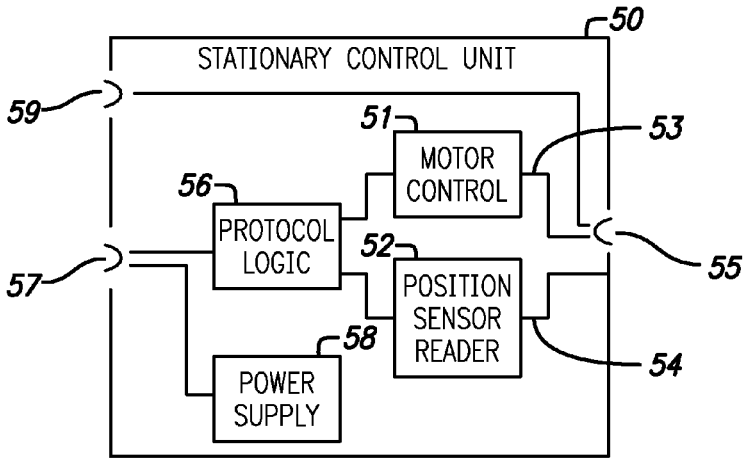
FIG. 3 shows schematically a hand-held control unit according to the present invention.
Figure 4:
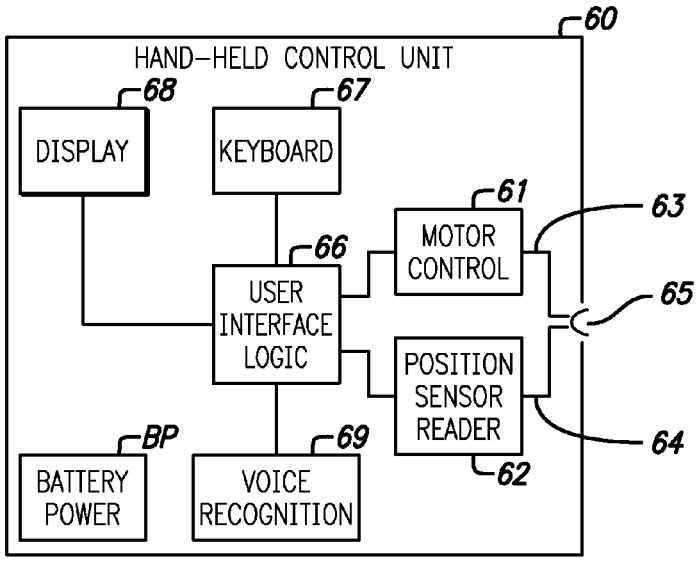
FIG. 4 shows schematically a stationary control box according to the present invention.

The remaining components of the control system are disposed in a separate, external control unit, located outside but in the vicinity of the antenna unit 70, either in a stationary control unit 5, as shown in FIG. 4, or in a hand-held control unit 6, as shown in FIG. 3.

In FIG. 3 there is shown schematically the major components contained in a stationary control unit 50 in the form of a box which is preferably mounted on the lower end wall of the casing of the antenna unit 70. These major components include a motor control circuit 51 and a position sensor reader or decoder 52, these components being connected via electrical wires 53 and 54, respectively, to a connector 55, and a logic circuit 56 coupled between the position sensor reader 52 and the motor control circuit 51 and also to another connector terminal 57, e.g. for connection to the antenna line master control unit (MCU) 40 in an associated base station 10 (see FIG. 1). The logic circuit 56 may contain a predetermined control algorithm, or an algorithm which is adjustable from the antenna line master control unit 40 (or an operation and maintenance centre (OMC) 3, also indicated in FIG. 1).

The electrical components in the stationary control unit 50 are powered via a power supply 58 being fed e.g. from the associated base station 1 which is assumed to be located at a relatively close distance.

The stationary control unit 50 can be easily mounted adjacent to the casing of the antenna unit 70, and is easy to replace by means of the connector 55 (apart from conventional mechanical fasteners). Thus, the antenna unit 70 can be retained unaltered, while the stationary control unit or box 50 is replaced. This is a convenient and relatively inexpensive way to upgrade the antenna system by way of a new control system meeting any new requirements or standards.

As an alternative or supplement to the stationary control unit 50, the present invention provides for a hand-held control unit 60, by means of which the electrical tilt of the antenna unit 70 can be adjusted manually. The hand-held control unit 60 is preferably designed like an ordinary TV remote control device, or the like, and comprises a number of battery powered circuits (battery BP), including a motor control circuit 61 (corresponding to the circuit 51 in the stationary unit 50) and a position sensor reader 62 (corresponding to the reader 52 in the stationary unit 50) as well as a user interface logic circuit 66 (corresponding to but being different from the logic circuit 56 in the stationary unit 50). The user interface logic circuit 66 is coupled to a manual tilt setting means in the form of keyboard 67 with keys, turnable knobs or similar finger operated elements or voice control means including a microphone and voice recognition circuit 69. Preferably, the hand-held control unit 60 also includes a display 68 for visual indication of relevant data, e.g. the current setting of the electrical tilt, possible diagnostic data related to the antenna unit and possibly also the charging status of the battery BP.

When the hand-held control unit 60 is used as a supplement to the stationary control unit 50, the terminal 65 of the hand unit 60 is connected to a terminal 59 of the stationary unit 50 whereby the components inside the stationary unit 50 are bypassed via a conduit leading directly to the opposite terminal 55, so that the motor control circuit 61 and the position sensor reader 62 are directly connected to the motor 75 and the position sensor 74 in the antenna unit 70. As an alternative, of course, it is possible to adapt the hand-held unit 70 such that it can be connected to the terminal 57 of the stationary unit 50 and adjust the programming of the logic circuit 56 by means of the manual tilt setting means of the hand-held unit 60.

Figure 5:
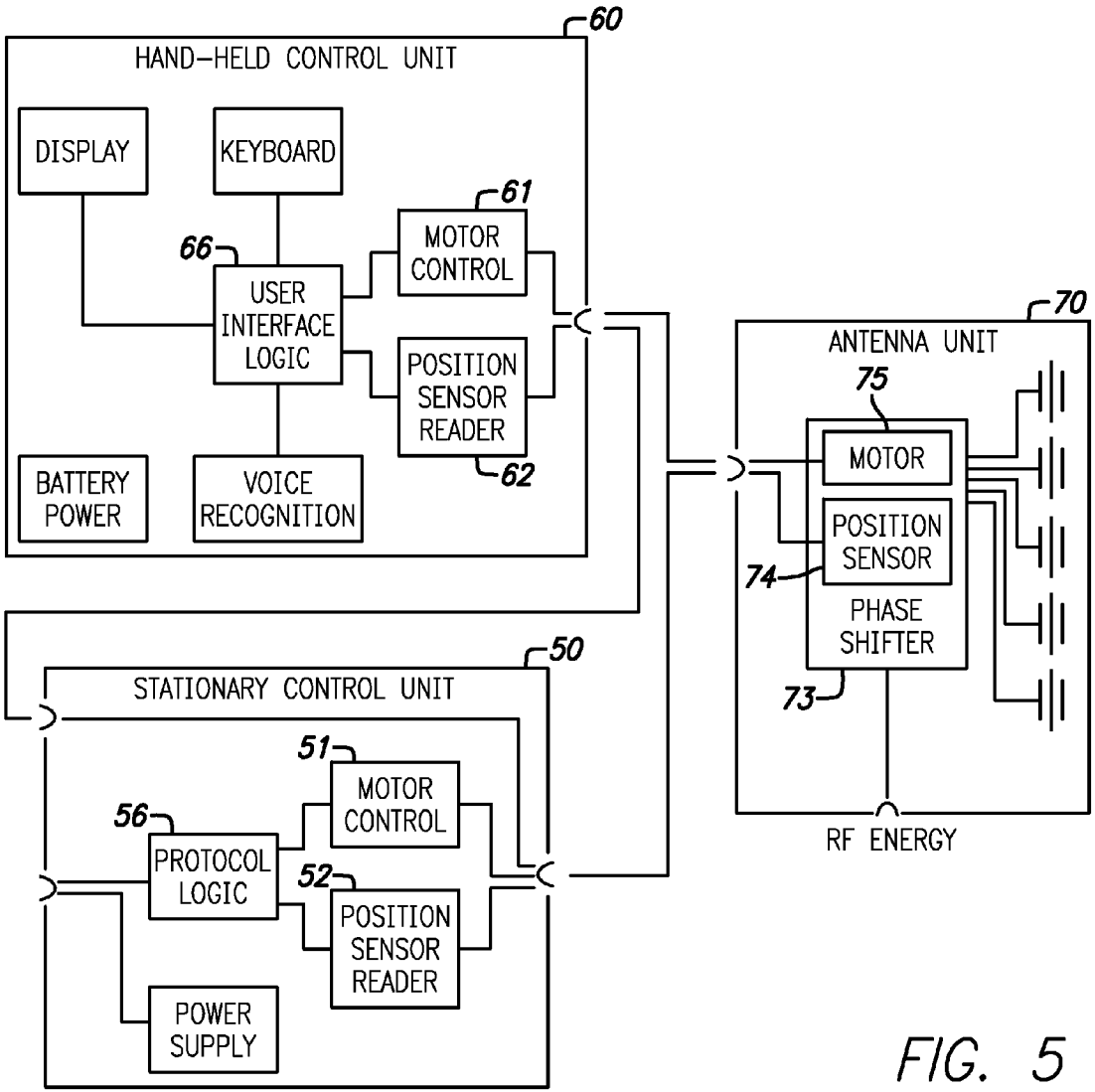
FIG. 5 shows schematically a control system according to the present invention.

FIG. 5 shows how the antenna unit 7, the stationary control unit 50 and the hand-held control unit 60 are mutually interconnected by electrical conduits and connectors, it being understood that normally, only one of the units 50 and 60 are used in practice.

In FIG. 6 there is shown a modified embodiment involving a capacitive coupling between the antenna unit 70', the stationary control unit 50' and the hand-held control unit 60'. In such an embodiment, there is also a need for a signal converter SC connected to the motor and the position sensor inside the antenna unit 70'.

The control system and the antenna system according to the invention may be modified by those skilled in the art, as compared to the preferred embodiments described above. The various electrical connectors between the units 70 and 50,60 may be disposed at different locations. However, it is preferable to have a stationary control box located adjacent to the lower end of the antenna unit, e.g. adjacent to the lower end wall of the antenna casing, and to arrange the electric connector (79, FIG. 2) at this lower end wall. In this way, it will be protected somewhat from rain and snow and will also be easily accessible for connection or replacement of the external unit 50 and/or 60.

Instead of a linearly movable rod, forming a part of the tilt adjusting mechanism, a revolving wheel can be used. Such a wheel can easily be driven by an electrical motor.

Finally, it is possible to locate the position sensor decoder (52; 62) in the first part of the control system within the antenna casing, rather than in the second part (as illustrated in the examples).

The invention claimed is:

1. A control system for controlling the electrical tilt, i.e. the electrically controlled inclination of a radiated beam, of an antenna, e.g. a base station antenna, the antenna being provided with a casing accommodating a number of antenna elements, a feeder cable coupled to said antenna elements for feeding RF energy to and from said antenna elements, a phase shifting device including a tilt adjusting mechanism with a displaceable mechanical element for adjusting an electrical tilt setting of the antenna lobe being radiated from the antenna, said control system comprising an actuating device, including an electrical motor for actuating said displaceable mechanical element, and a position sensor for sensing the position of said displaceable mechanical element, wherein the control system is divided into two parts, namely a first part, including the entire tilt adjusting mechanism, said electrical motor and said position sensor, these elements constituting internal components being arranged inside the antenna casing, and a second part, including the remaining components of the control system, these components constituting external components, including an electrical motor control circuit, and a logic circuit determining the electrical tilt setting, said external components being disposed in at least one separate, external control unit located outside but in the vicinity of said antenna casing, and being adapted for operative coupling, by way of a direct electric wire connection or a capacitive coupling, to said internal components located inside said antenna casing whereby said first part and second part are interconnected with control and feedback lines to achieve closed loop control of movement of the mechanical element by way of signals.

2. The control system defined in claim 1, wherein said external components inside said at least one external control unit also include a position sensor decoder.

3. The control system defined in claim 1, wherein said at least one external control unit comprises a stationary control box being located adjacent to said antenna casing, said stationary control box being mounted for easy replacement thereof.

4. The control system defined in claim 3, wherein said logic circuit in said stationary control box operates according to a protocol algorithm being pre-programmed or being remotely controlled.

5. The control system defined in claim 3, wherein said stationary control box also accommodates a power supply device being fed from an external source.

6. The control system defined in claim 1, wherein said external components inside said at least one external control unit are electrically connected to said internal components within said antenna casing via an electrical connector.

7. The control system defined in claim 1, wherein said external components inside said at least one external control unit are coupled capacitively to said internal components inside said antenna casing.

8. The control system defined in claim 1, wherein said at least one external control unit comprises a handheld, battery powered control device being operatively connectable to said internal control components inside said antenna casing, said logic circuit being constituted by a user interface logic circuit which is coupled to a manual tilt setting means.

9. The control system defined in claim 8, wherein said user interface logic circuit is coupled to a display for visual indication of the current electrical tilt setting of the antenna.

10. The control system defined in claim 8, wherein said user interface logic circuit is coupled to voice control means serving as said manual tilt setting means.

11. The control system as defined in claim 8, wherein said at least one external control unit comprises, in addition to said handheld control device, a stationary control box being located adjacent to said antenna casing and being operatively coupled to said internal components of the control system, said handheld control device being connectable to said stationary control box for manual setting of the electrical tilt of the antenna instead of automatic or remote control.

12. The control system defined in claim 11, wherein the tilt setting is adjusted by modifying the program in said logic circuit in said stationary control box by way of said handheld control unit.

13. The control system defined in claim 11, wherein the components in said stationary control box are bypassed during said manual setting.

14. An antenna system comprising a base station antenna and a control system for controlling the electrical tilt, i.e. the electrically controlled inclination of a radiated beam, of the base station antenna, the antenna being provided with a casing accommodating a number of antenna elements, a feeder cable coupled to said antenna elements for feeding RF energy to and from said antenna elements, a phase shifting device including a tilt adjusting mechanism with a displaceable mechanical element for adjusting an electrical tilt setting of the antenna lobe being radiated from the antenna, said control system comprising an actuating device, including an electrical motor for actuating said displaceable mechanical element, and a position sensor for sensing the position of said displaceable mechanical element, wherein the control system is divided into two parts, namely a first part, including the entire tilt adjusting mechanism, said electrical motor and said position sensor, these elements constituting internal components being arranged inside the antenna casing, and a second part, including the remaining components of the control system, these components constituting external components, including an electrical motor control circuit, and a logic circuit determining the electrical tilt setting, said external components being disposed in at least one separate, external control unit located outside but in the vicinity of said antenna casing, and being adapted for operative coupling, by way of a direct electric wire connection or a capacitive coupling, to said internal components located inside said antenna casing whereby said first part and second part are interconnected with control and feedback lines to achieve closed loop control of movement of the mechanical element by way of signals.

* * * * *